United States Patent [19]

Alexander et al.

[11] 4,186,689

[45] Feb. 5, 1980

[54] ANIMAL SLING

[76] Inventors: John T. Alexander, 616 Mount Lebanon Rd., Wilmington, Del. 19803; John D. Heppner, 83 Doe Run Dr., Holland, Pa. 18966

[21] Appl. No.: 842,792

[22] Filed: Oct. 17, 1977

[51] Int. Cl.[2] ..... A61D 3/00

[52] U.S. Cl. ..... 119/102

[58] Field of Search ..... 119/102, 100, 96; 294/77, 74

[56] References Cited

U.S. PATENT DOCUMENTS

| | | | |
|---|---|---|---|
| 346,285 | 7/1886 | Hime | 119/102 |
| 1,015,239 | 1/1912 | Miller | 119/102 |
| 1,064,367 | 6/1913 | Musselman | 119/102 |
| 1,083,627 | 1/1914 | McFadden | 119/102 |
| 2,813,745 | 11/1957 | Frieder et al. | 294/77 |

*Primary Examiner*—Hugh R. Chamblee

*Attorney, Agent, or Firm*—Zachary T. Wobensmith, 2nd; Zachary T. Wobensmith, III

[57] ABSTRACT

A sling is provided for supporting horses and other large four legged animals in an upright position for short or extended periods of time while in a stationary or traveling mode. The sling includes three major parts: a T-shaped member which conforms to the sternum and shoulders of the animal; a belly band or sternum abdominal band attached to the T-member; and a tail piece attached to the abdominal band by six adjustable straps. If desired, straps can be connected to a halter and to the sternum abdominal band to provide support for the animal's head. Straps are attached to the abdominal sternum support band which can be detachably secured to a sling support for raising and lowering of the sling, and if desired, moving the animal along a track from one location to another. The entire sling is formed of an easily cleaned fabric.

10 Claims, 5 Drawing Figures

ANIMAL SLING

BACKGROUND OF THE INVENTION

1. Field of the Invention

This invention relates to an animal sling for supporting a horse or other large four legged animal in an upright position in the conscious or anesthetized or paralyzed states.

2. Description of the Prior Art

It is well known that horses and other large four legged animals are very difficult to maneuver.

When a horse or other large four legged animal is in need of medical or surgical teratment, requiring the use of a sling, it is very difficult to move the animal for such treatment and to adequately support it during treatment and recovery. Horses are particularly subject to leg injuries, and many courses of treatment require that the horse's weight be kept off the injured limb for a sufficient period of time for the injuries to heal, during which time adequate support is required to maintain the horse in an upright position.

In addition horses are particularly subject to emotional and health problems if they are unable to rise or remain in a standing position and often succumb to minor injuries whereas if they can be supported in a standing position, they may survive.

It is not only important that the sling provide support at the center of gravity of the animal for maneuverability and more efficient ventilation, but that the support be evenly distributed over the body of the animal, and that the sling be capable of suspending the animal in a pool filled with water or with its legs touching the ground or off of the ground.

The presently available slings used for large four legged animal support do not provide adequate support for the animal, compromise the ventilation, and often cause damage to the internal parts of the animal. In addition the slings are difficult to clean, do not allow for air contact and do not conform to the animal's body, all of which promotes sweating, chaffing and skin irritation. In many instances, such slings are unsafe since the animal is able to extricate itself either forward or backward out of the sling and then being unrestrained, causes severe injury to itself or its surroundings.

The sling of our invention can be used to raise the animal from a reclining to an upright or standing position, retain it in the upright position during transport to a treatment facility, and support the animal during treatment and recovery, as required, without causing injury to the skin or internal parts of the animal.

SUMMARY OF THE INVENTION

An animal sling for use on large four legged animals is provided of three piece construction, which includes a T-member supporting the sternum and shoulders of the animal which is detachably secured to an abdominal sternum support band, and a tail piece supporting the rump of the animal adjustably detachably secured to the abdominal sternum band, with straps from the abdominal sternum band engageable with a hook or other support for sling suspension.

Straps can be attached to a halter on the animal's head and to the abdominal sternum band to provide support for the animal's head.

The principal object of the invention is to provide an animal sling for horses or other large four legged animals that provides positive support for the animal, inducing little or no internal or external injury to the animal.

A further object of the invention is to provide an animal sling which is simple and inexpensive to construct but which is sturdy and reliable in use.

A further object of the invention is to provide an animal sling which can be used by anyone with a minimum of required training.

A further object of the invention is to provide an animal sling that can conform to the contour of the animal's body and provide good support distribution.

A further object of the invention is to provide an animal sling which can be quickly attached and detached from an animal, with one size of sling being useful with a wide variety of sizes and types of animals.

A further object of the invention is to provide an animal sling of the character aforesaid in which provisions are made to provide support for the animal's head.

A further object of the invention is to provide an animal sling that can be easily and quickly cleaned.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
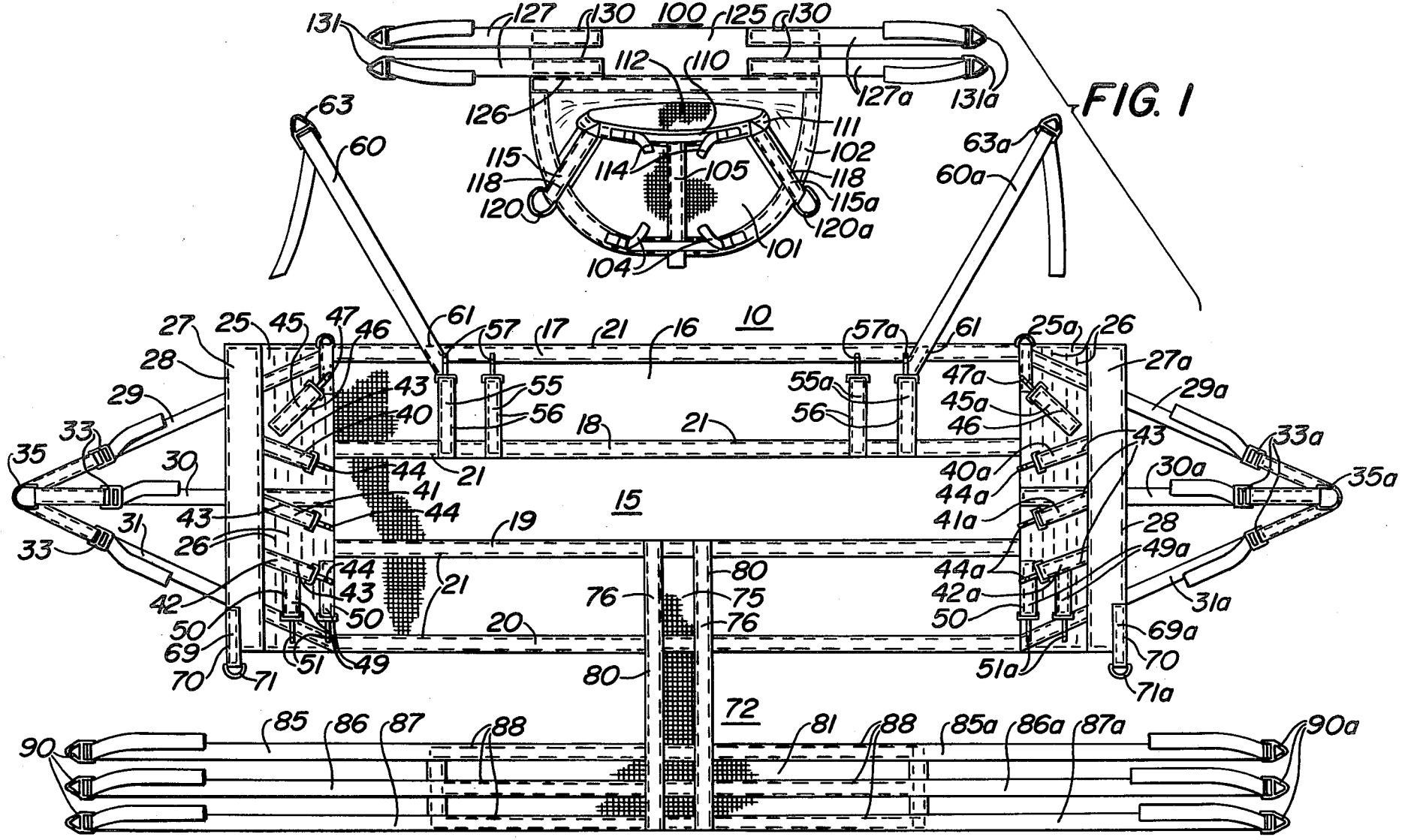
FIG. 1 is a top plan view of the components of an animal sling in accordance with the invention.
Figure 2:
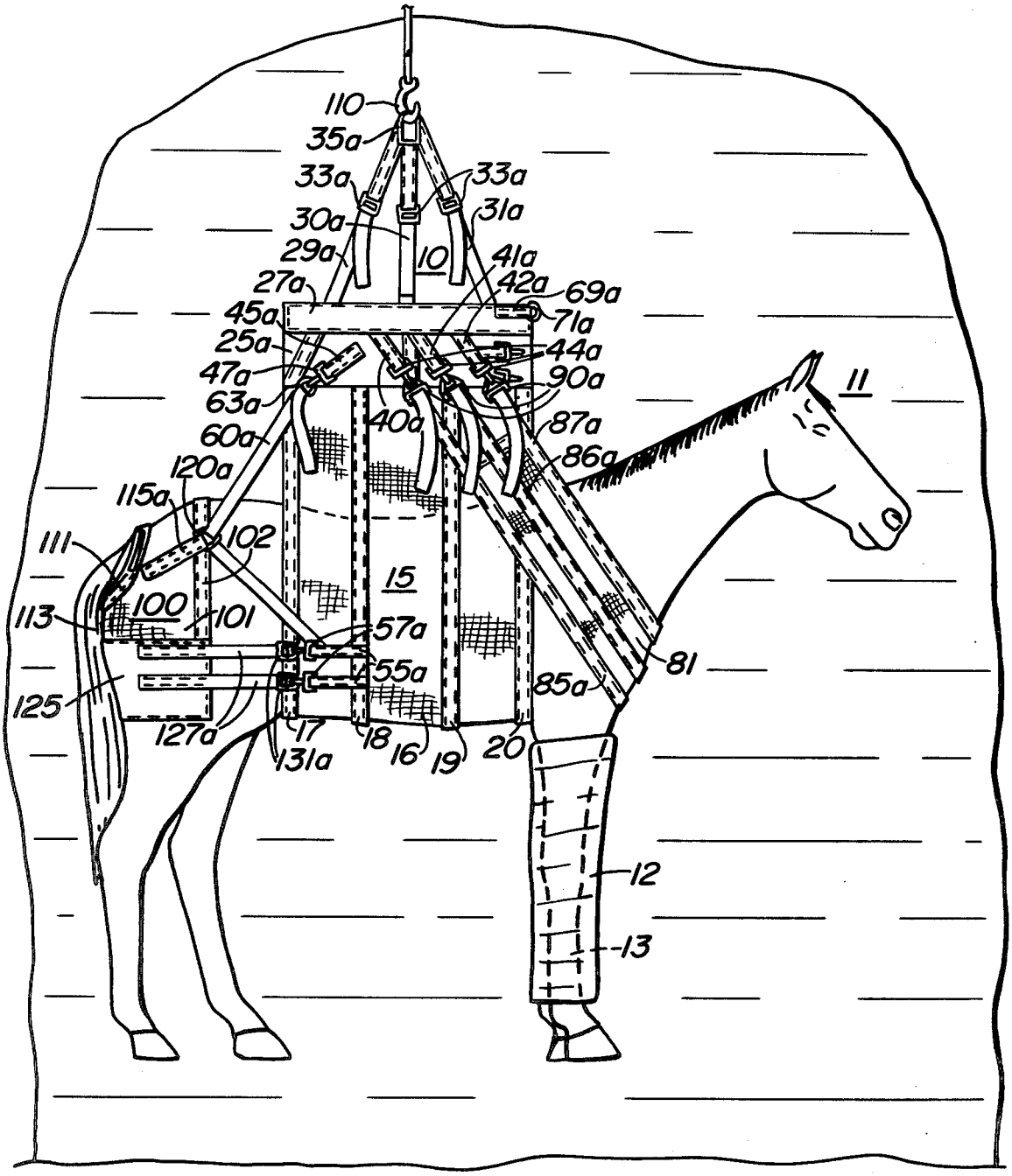
FIG. 2 is a right side elevational view of the animal sling supporting a horse which is shown as having its right foreleg in a cast.
Figure 3:
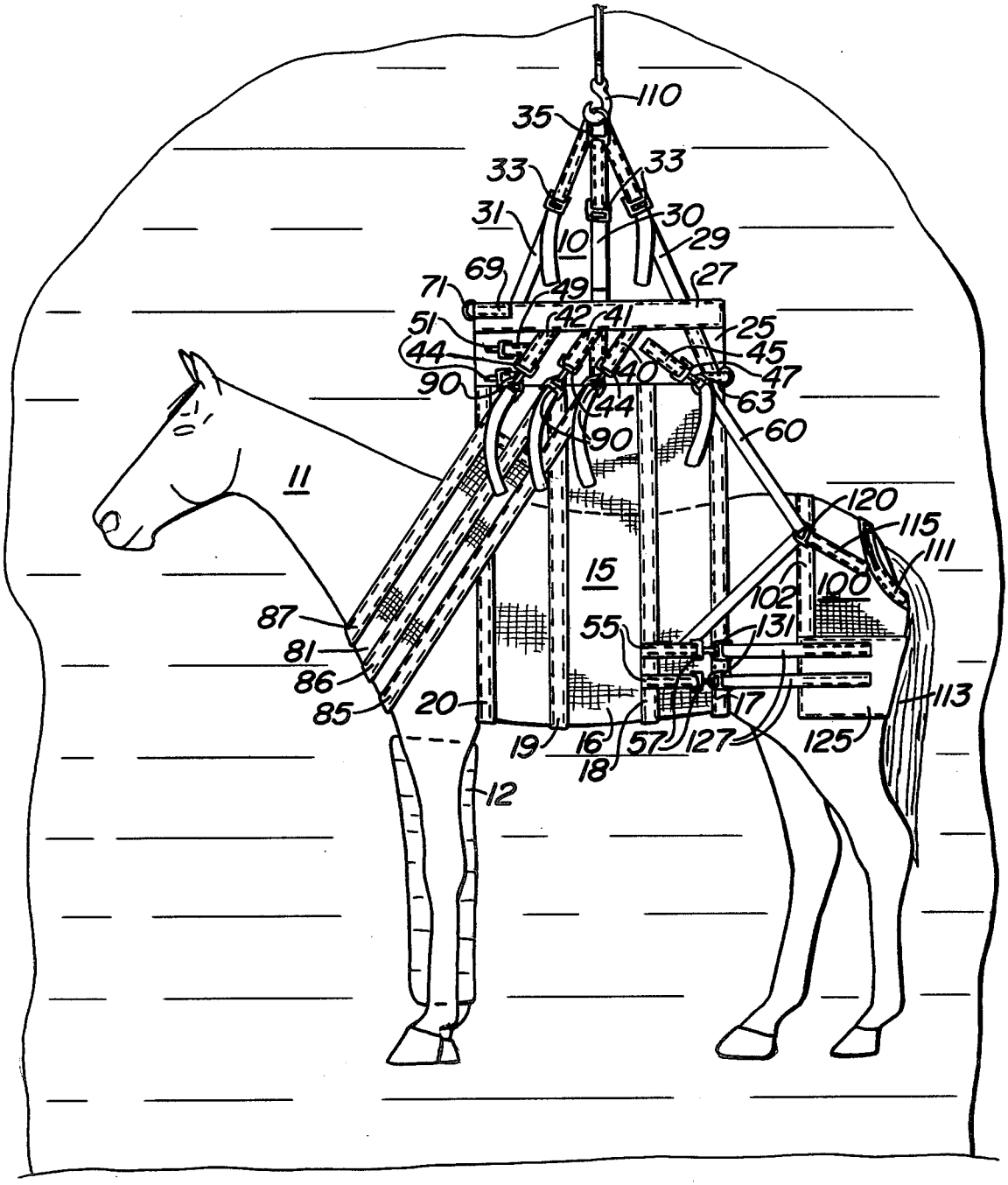
FIG. 3 is a side elevational view similar to FIG. 2 taken from the left side of the horse.

Referring now more particularly to the drawings and FIGS. 1 to 3 thereof, a preferred embodiment of animal sling 10 is illustrated which in FIGS. 2 and 3 is in place on an injured horse 11, which has a cast 12 on its right foreleg 13.

The sling 10 includes an abdominal sternum support band or belly band 15 with a central rectangular panel portion 16 preferably of an open mesh woven fabric material such as nylon which can readily conform to the animal's contour and does not chafe or cause damage to the animal's skin. The panel 16 has four reinforcement strips 17, 18, 19, and 20 fastened thereto by lines of stitching 21 and extending substantially the length thereof. The strips 17, 18, 19 and 20 are preferably formed of a closely woven nylon fabric of well known type.

The panel 15 is symmetrical as shown in FIG. 1 and has end panels 25 and 25*a* secured thereto at its ends by lines of stitching 26. The panels 25 and 25*a* each has an additional panel 27 or 27*a* secured thereto by lines of stitching 28, to provide a pocket for the reception of a spreader bar (not shown) to maintain the width of the sling.

The panel 15 has sling support straps 29, 29*a*, 30, 30*a*, 31 and 31*a* of nylon webbing secured thereto at each end thereof by lines of stitching 32. The straps 29, 30, and 31 each has an adjustable buckle 33 thereon for varying their length, the straps extending through a D-ring 35 to which they can be permanently or detachably engaged. The straps 29*a*, 30*a*, and 31*a* have buckles 33*a* engaged therewith for varying the length thereof, all three straps being also looped through a D-ring 35*a*.

The panels 25 and 25*a* have short parallel straps 40, 40*a*, 41, 41*a*, 42, and 42*a* of nylon webbing secured thereto by lines of stitching 43, extend inwardly towards the front center of the panel 15 and are equipped with quick release snap rings 44 and 44*a* of well known type. The panels 25 and 25*a* also have straps 45 and 45*a* of nylon webbing attached thereto by lines of stitching 46, which extend towards the central rear portion of the panel 15, and have quick release snap rings 47 and 47*a* thereon of well known type. The panels 25 and 25*a* have additional pairs of straps 49 and 49*a* of nylon webbing secured thereon by lines of stitching 50, parallel to each other, and to the end margins of the panels 27 or 27*a*, extend toward the front portion of the panel 15 and are provided with quick release snap rings 51 and 51*a* of well known type.

The panel 15 has pairs of short straps 55 and 55*a* of nylon webbing secured thereon by lines of stitching 56, parallel to each other and to the end margins of panel 15, extend towards the rear portion of panel 15, intersecting the reinforcing strip 18 and with quick release snap rings 57 and 57*a* thereon. The panel 15 has long adjustable straps 60 and 60*a* of nylon webbing attached thereto by lines of stitching 61, adjacent the reinforcement strip 17, extending rearwardly and outwardly of panel 15, and provided with adjustable D-ring buckles 63 and 63*a*.

The panels 25 and 25*a* each has a short halter strap 69 and 69*a* of nylon webbing secured thereto by lines of stitching 70 with D-rings 71 and 71*a* thereon.

The panel 15 has a T-shaped member 72 secured thereto, which includes a panel 75 with edge reinforcement strips 76 secured thereto and to panel 15 by lines of stitching 80. The panel 75 is preferably formed of the same open mesh fabric as panel 15, extends frontwardly of panel 15 and has a panel 81 secured thereto in perpendicular relation, which panel 81 is also of open weave mesh fabric. The panel 81 has straps 85, 85*a*, 86, 86*a*, 87, and 87*a* of nylon webbing secured thereto by lines of stitching 88, and provided with adjustable D-ring buckles 90 and 90*a*, which can be engaged with the quick release snap rings 44 or 44*a* and 47 or 47*a* in a manner to be described below.

As illustrated in FIG. 1, a tail piece 100 is provided which is separate from the two pieces of the sling just described.

The tail piece 100 includes a central panel 101 of half circle configuration constructed of an open mesh woven fabric such as nylon, with a reinforcement strip 102 of a nylon fabric secured thereto by lines of stitching 103 around the perimeter which strip includes adjustable straps 104 for varying the length of the strip 102.

The panel 101 has a reinforcement strip 105 of nylon fabric secured thereto by lines of stitching 106, centrally located with one end fastened to strip 102 and the other end fastened to a strip 110 of nylon fabric, secured to panel 101 by lines of stitching 111 which serves to define the perimeter of an opening 112 for the horse's tail 113. The strip 110 has adjustable straps 114 of nylon webbing for varying the length.

Straps 115 and 115*a* of nylon webbing are provided secured to panel 101, strips 102 and 110 by lines of stitching 118, with large D-rings 120 and 120*a* attached thereto for engagement by straps 60 and 60*a* in a manner to be described below. The D-rings 120 and 120*a* are of sufficiently large diameter to permit the passage of the buckles 63 and 63*a* therethrough.

The panel 101 has a panel 125 of generally rectangular configuration secured thereto by lines of stitching 126, and is formed of a closely woven mesh fabric, preferably of nylon.

The panel 125 has pairs of straps 127, and 127*a* of nylon webbing secured thereto by lines of stitching 130, with adjustable D-ring buckles 131 and 131*a* attached thereto which can be engaged with the snap rings 57 and 57*a* in a manner to be described below.

Figure 4:
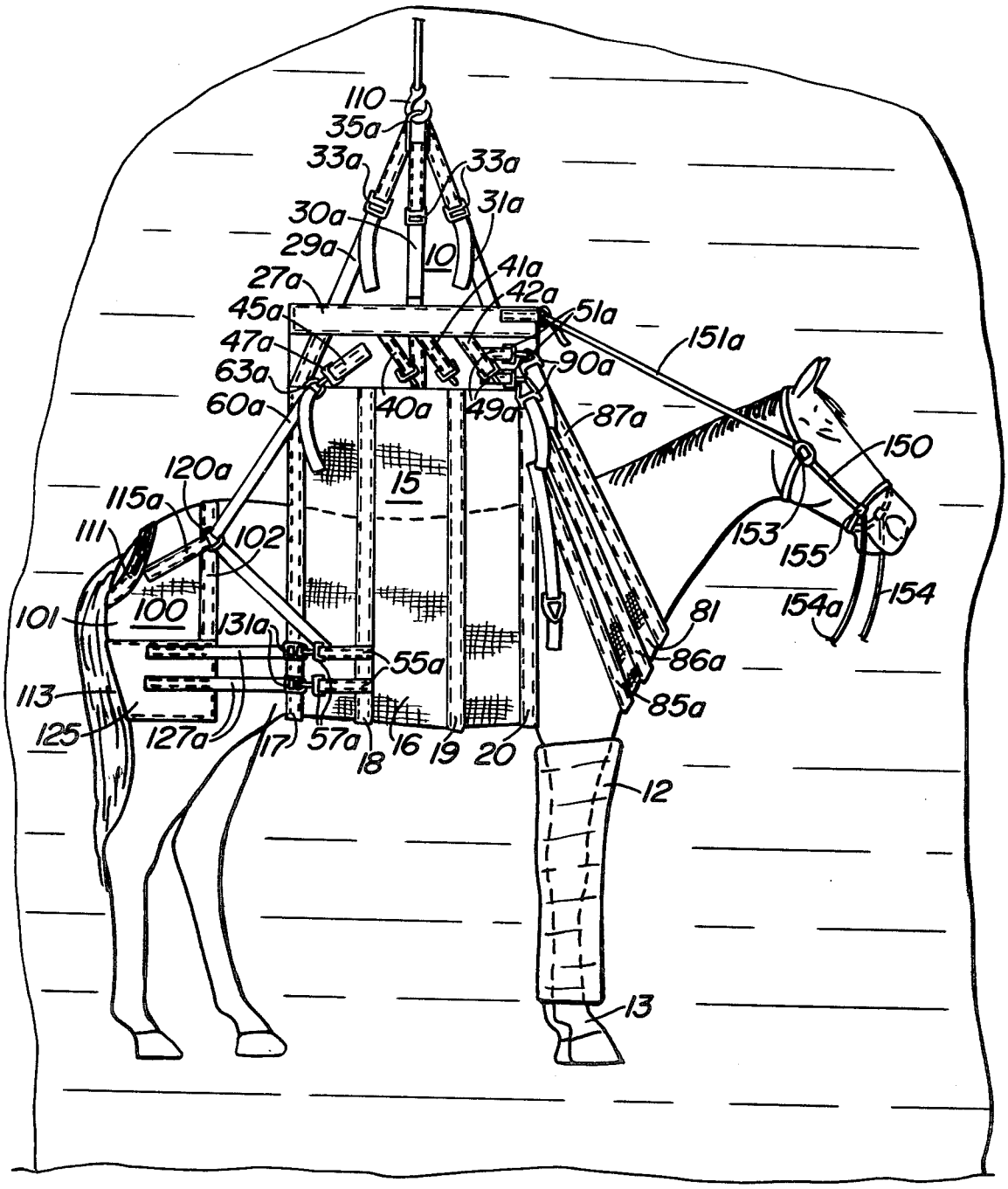
FIG. 4 is a right side elevational view of the sling of FIG. 1 with support of the horse's head and illustrating the positioning of the sling when the horse has an injured shoulder, or fractured scapula or humerus.
Figure 5:
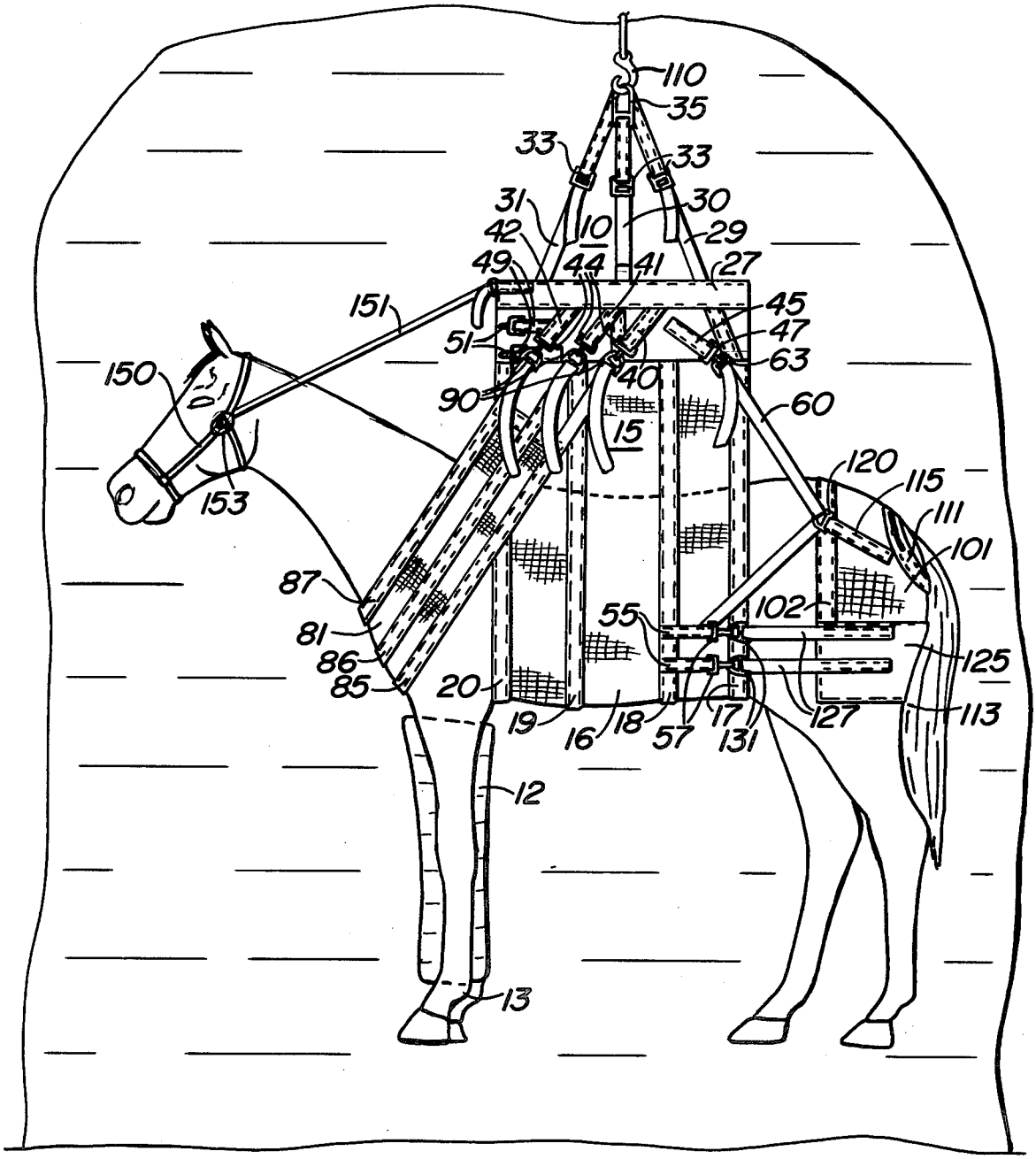
FIG. 5 is a left side elevational view of the sling shown in FIG. 4.

Referring now to FIGS. 4 and 5, the horse 11 and sling 10 are as described for FIGS. 1 to 3 except that the horse 11 has a halter 150 of well known type on its head 152 with nylon webbing straps 151 and 151*a* attached to the halter cheek rings 153 and D-rings 71 and 71*a* of straps 69 and 69*a* by quick release snap rings 44 and 44*a*. The nylon webbing straps 151 and 151*a* each have adjustable buckles 33 and 33*a* engaged therewith for varying the length thereof.

It should be noted that the quick release snap rings, the buckles and the D-rings described above are all of rugged construction preferably formed of stainless steel and are of a known tested tensile strength.

The mode of operation and use will now be pointed out and as particularly applied to a standing horse.

The sling 10 should be laid out with the quick release snap rings 44, 44*a*, 47, 47*a*, 57, and 57*a* next to the floor or ground. The adjustable sling supporting straps 29, 29*a*, 30, 30*a*, 31, and 31*a* attached to the D-rings 35 and 35*a* should be arranged so that the center of the D-rings 35 and 35*a* will be over the center of gravity (the withers) of the horse 11. The T-member 72 is carefully folded on top of the sternum abdominal band 15. The tail section 100 with one side attached is also folded on top of the sternum abdominal band 15. The two sides of the band 15 are brought together by grasping the D-rings 35 and 35*a* and the sling 10 is laid beside the horse 11 in this configuration.

The horse 11 is suitable tranquilized with a tranquilizer such as xylazine (Rompun, a product of Haver-Lockhart Laboratories, Division of Bayvet Corporation, Shawnee, Kansas 66201). It is preferred that three persons be available to apply the sling 10 to the horse 11. One person can then be positioned at the head with the two halter shanks 154 and 154*a* each attached to the cheek rings 155 of the halter 150. The nylon webbing straps 151 and 151*a* are attached to the halter cheek rings 153 and D-rings 71 and 71*a* by quick release snap rings 44 and 44*a*. The nylon webbing straps are adjusted for even support of the head in a normal attitude through adjustable buckles 33 and 33*a*. A tail rope (not shown) may be attached to the horse's tail 113. The other two persons can be positioned on opposite sides of the horse 11 so that complete control of the horse is possible if needed.

The folded sling 10 with the T-member 72 forward, tail section 100 posterior is positioned beside the animal and one D-ring 35 is passed with the sternum abdominal band 15 under the horse 10 and the D-rings 35 and 35*a* of the belly band are secured to a hook 160 of a suitable hoist (not shown).

The T-member 72 is passed between the front legs, and the D-rings 35 and 35*a* and abdominal sternum band 15 are raised so that the band 15 lies just below the sternum of the horse. The T-member 72 is fastened to the band 15 by attachment of buckles 90 and 90*a* to snap rings 44 and 44*a* on the respective sides of the horse 11. The T-member 72, webbing straps 85, 85*a*, 86, 86*a*, 87 and 87*a* are snugly tightened by means of the buckles 90 and 90*a*.

The tail 113 is placed through the opening 112 in the tail piece 100 and webbing straps 60 and 60*a* and buckles 63 and 63*a* are passed through the D-rings 120 and 120*a* on the tail section and secured to the snap rings 47 and 47*a* on the band 15. The D-rings 131 and 131*a* on the webbing straps 127 and 127*a* are attached to snap rings 57 and 57*a* of band 15 and the webbing straps 127 and 127*a* are tightened evenly on both sides of the sling 10. The horse 11 may then be lifted and supported as desired without injury from the sling or any of its components.

When it is desired to remove the sling 10, the tail section 15 is removed first by releasing a webbing strap 60 or 60*a* and passing it back through the D-ring 120 or 120*a* on the tail piece 100. The webbing strap 127 on one side is released and the tail piece 100 is taken to the opposite side of the horse 11.

The T-member 72, webbing straps 85, 85*a*, 86, 86*a*, 87, and 87*a* are unsnapped. The D-rings 35 and 35*a* are unhooked from the hook 160 extending from the supporting hoist (not shown) and one ring 35 or 35*a* is passed under the horse toward the side of the attached tail piece 100 permitting the sling to be moved away from the horse.

The procedure is similar for applying the sling to an animal that is down with the exception that the animal would have to be rolled over onto the sling.

Referring now to FIGS. 4 and 5, the horse 11 as illustrated has at least one injured shoulder which requires that the straps 86, 86*a*, 87 and 87*a* be attached to the straps 49 and 49*a*, by D-rings 90 and 90*a* and snap rings 51 and 51*a*. In addition the nylon webbing straps 151 and 151*a* are attached to halter cheek rings 153 and to D-rings 71 and 71*a* of the straps 69 and 69*a* to provide added support to the horse's head.

While the sling has been described as being preferably formed of nylon fabric, other suitable fabrics such as polyester can be used if desired.

The sling being formed of a non-irritating fabric and with corrosion resistant hardware can be easily and quickly disenfected and used on different animals without dimensional change, is also suitable when the animal is placed in a pool of water for treatment and thus enjoys a long service lifg.

It should be noted that the sling can be used on horses, ponies, zebras, and many other large four legged animals without modification and with suitable dimensional changes, could be used on rhinocerous, elephants and the like.

It will thus be seen that an animal sling has been provided with which the objects of the invention are attained.

We claim:

1. An animal sling for use with a hoist on large four legged animals which comprises sternum abdominal panel means having connecting end panels disposed above the body of the animal for connection to a hoist, a T-shaped member which comprises two panels connected together in a "T" configuration, one of said panels conforming to the shoulders or neck of the animal and the other of said panels being connected to a side margin of said sternum abdominal panel means, separately adjustable strap means carried by said one of said panels of said T-shaped member for securing said one of said panels to said end panels, converging adjustable supporting straps extending upwardly from said end panels for connection to a hoist, a tail piece for engagement with the rump of the animal in restraining relation thereto, strap means including horizontally extending strap members connecting said tail piece to said sternum abdominal panel means, and adjustable strap means connected to said abdominal panel means and slidable through means on said tail piece and connected with said end panels.

2. An animal sling as defined in claim 1 in which said T-shaped member panels are formed of an open mesh fabric with edge reinforcement strips secured thereto, said separately adjustable strap means are carried by said one of said panels and include adjustable buckles mounted thereon.

3. A sling component as defined in claim 1 in which said buckles are D-ring buckles.

4. An animal sling as defined in claim 1 in which said open mesh weave fabric is of polyester.

5. An animal sling as defined in claim 1 in which said open mesh weave fabric is of nylon.

6. An animal sling as defined in claim 1 in which a halter is provided for engagement with the head of the animal, and straps are provided which are engaged with said halter and straps carried by said abdominal support band for restraining the head in an upright position.

7. An animal sling as defined in claim 1 in which said sternum abdominal panel means has strap means which include a plurality of straps with quick release snap rings thereon for engagement with said horizontally extending strap members from said tail piece.

8. An animal sling as defined in claim 1 in which strap means are carried by said end panels connecting to said separately adjustable strap means from said one of said panels and which includes straps with quick release snap rings thereon.

9. An animal sling as defined in claim 1 in which said tail piece for engagement with the rump of the animal includes a panel having a rectangular portion and a portion extending therefrom with a curved margin, said panel having an opening for the tail of the animal, said means on said tail piece including a plurality of straps extending from the ends of said rectangular portion with D rings thereon for engagement with said adjustable strap means from said abdominal panel means.

10. An animal sling as defined in claim 9 in which strap means are carried by said end panels connecting to said adjustable strap means which means are slidable through means on said tail piece and which include straps with D rings thereon.

* * * * *